United States Patent [19]

Gross et al.

[11] 4,362,530

[45] Dec. 7, 1982

[54] DYEING AUXILIARIES CONTAINING MIXED ANIONIC, CATIONIC AND NON-IONIC ETHYLENE OXIDE ADDUCTS

[75] Inventors: Rolf Gross, Reinach; René Fricker, Allschwil, both of Switzerland

[73] Assignee: Sandoz Ltd., Basel, Switzerland

[21] Appl. No.: 245,290

[22] Filed: Mar. 19, 1981

[30] Foreign Application Priority Data

Mar. 20, 1980 [CH] Switzerland ..... 2198/80

[51] Int. Cl.[3] ..... D06P 3/82

[52] U.S. Cl. ..... 8/529; 8/531; 8/534; 8/539; 8/554; 8/557; 8/586; 8/604; 8/638; 252/8.8; 252/8.9

[58] Field of Search ..... 8/529, 534, 557, 586, 8/604, 638, 539, 531, 554; 252/8.8, 8.9

[56] References Cited

U.S. PATENT DOCUMENTS 4,191,532 3/1980 Gross et al. ..... 8/527

FOREIGN PATENT DOCUMENTS 1113994 5/1968 United Kingdom .

1184628 3/1970 United Kingdom .

*Primary Examiner*—A. Lionel Clingman

*Attorney, Agent, or Firm*—Gerald D. Sharkin; Richard E. Vila; Thomas C. Doyle

[57] ABSTRACT

A composition containing (A) 10 parts by weight of an anionic product obtained by addition of 5 to 20 mols of ethylene oxide to an aliphatic saturated or unsaturated alcohol of 10 to 24 carbon atoms, followed by carboxymethylation (B) 1 to 15 parts by weight of a cationic addition product of 50 to 150 mols of ethylene oxide to a fatty amino-($C_{2-3}$)alkylene-amine (C) 1 to 10 parts by weight of a non-ionic addition product of 20 to 150 mols of ethylene oxide to castor oil, or a non-ionic sequenced addition product of 20 to 150 mols of ethylene oxide and 1 to 10 mols of propylene oxide to castor oil, and (D) 1 to 20 parts by weight of a N-($\beta$-hydroxy-($C_{2-4}$)alkyl)-fatty acid amide, is a dyeing auxiliary useful for the dyeing in one bath or printing of a mixed textile substrate comprising cationic dyeable fibres and anionic or disperse dyeable fibres.

17 Claims, No Drawings

DYEING AUXILIARIES CONTAINING MIXED ANIONIC, CATIONIC AND NON-IONIC ETHYLENE OXIDE ADDUCTS

The present invention relates to a dyeing auxiliary composition and to a process for dyeing blends of cationic dyeable fibres and fibres dyeable with anionic or disperse dyestuffs, in the presence of such a composition.

More particularly, the invention provides a composition comprising (A) 10 parts by weight of an anionic product obtained by addition of 5 to 20, preferably 10 to 15, mols of ethylene oxide to an aliphatic saturated or unsaturated alcohol of 10 to 24, preferably 12 to 20 carbon atoms, followed by carboxymethylation of the terminal hydroxy group (B) 1 to 15 parts by weight of a cationic addition product of 50 to 150, preferably 100 to 130, mols of ethylene oxide to a fatty amino-($C_{2-3}$) alkylene-amine (C) 1 to 10 parts by weight of a non-ionic addition product of 20 to 150, preferably 20 to 50 mols of ethylene oxide to castor oil, or a non-ionic sequenced addition product of 20 to 150 mols of ethylene oxide and 1 to 10 mols of propylene oxide to castor oil, and (D) 1 to 20 parts by weight of a N-($\beta$-hydroxy-($C_{2-4}$)alkyl)-fatty acid amide.

Component A may be a mixture of ethoxylated alcohols. Preferred component A is a mixture of oleyl and cetyl alcohol (preferably in a weight ratio from 1:2 to 2:1) ethoxylated with approximately 10 to 15 ethylene oxide units which is further carboxymethylated. Anionic polyglycol ethers of this type are commercially available or may be obtained by carboxymethylation according to known methods (e.g. employing chloroacetic acid or a salt thereof) of the corresponding non-ionic polyglycol ethers.

Component B is preferably an addition product of 100 to 130 mols of ethylene oxide to tallow fatty aminopropylamine. The amino group containing polyglycol ethers of type B are known and commercially available.

When component C is a sequenced ethylene oxide/propylene oxide addition product, it preferably comprises a sequence of from 10 to 60 ethylene oxide units, then from 1 to 10 propylene oxide units and finally 10 to 90 ethylene oxide units. Preferred component C is a commercially available addition product of 25 to 35 mols of ethylene oxide to castor oil.

Component D is preferably a N-($\beta$-hydroxy($C_{2-4}$)alkyl)amide of a fatty acid containing from 16 to 22 carbon atoms, more preferably N-($\beta$-hydroxyethyl)-tallow acid amide.

The weight ratio of components A:B:C:D is preferably 10:1–10:1–10:1–15, more preferably 10:1.5–8:1.5–8:-2–8, particularly 3:1:1:2.

The four-component compositions of the invention are preferably formulated with water. Preferred aqueous compositions are those containing 20 to 50%, preferably 25 to 35%, by weight of the four components A, B, C and D.

The aqueous compositions of the invention may be prepared according to known methods. Preferably, the components A, B, C, D are mixed together in any order under heating to 90° C. and stirred at this temperature until homogenization. Subsequently, demineralized water of 90° C. is added to this mixture which is further stirred at this temperature until homogenization. Components A, B, C and D may also be added with stirring to water heated to 90° C.

The compositions of the invention are useful dyeing or printing auxiliary agents. They are particularly suitable for dyeing in one bath in one or two steps mixed textile substrates comprising cationic dyeable fibres and anionic or disperse dyeable fibres.

Accordingly, the present invention further provides a process for dyeing in one bath or printing a mixed textile substrate comprising cationic dyeable fibres and anionic or disperse dyeable fibres, which process comprises using a dyebath or a printing paste containing in addition to the dyestuff(s) a composition as stated above.

Suitable mixed textile substrates are blends of cationic dyeable fibres, e.g. polyacrylonitrile or modified polyester or polyamide fibres, and of fibres dyeable with anionic or disperse dyestuffs such as natural or regenerated cellulosic fibres, e.g, cotton or cellulose acetate, polyester or synthetic or natural polyamide fibres, e.g. wool or nylon.

The textile substrate may be in any conventional form e.g. yarn, filaments, wovens, plush fabrics, knitted goods.

Suitable anionic dyestuffs which may be used include reactive, direct, acid and metal complex dyes. The preferred anionic dyestuffs are those having good solubility in cold water. In this regard, the particularly preferred anionic dyes are the following Colour Index dyes:

Acid Blue 227, 127:1
Acid Yellow 127, 111, 129, 112, 218, 75
Acid Orange 156
Acid Red 249, 261, 263, 215, 11
Reactive Yellow 69
Reactive Red 100

As regards the cationic dyestuff, such is preferably one easily formed into liquid or pseudo-liquid form, especially preferred being the following Colour Index dyes:

Basic Yellow 13, 82
Basic Red 22
Basic Blue 77, 141

The composition is preferably used in form of an aqueous preparation such as mentioned above. The amount of such an aqueous composition to be employed in the dyebath or printing paste depends on the blended substrate and the type of dyestuffs used. Satisfactory results are obtained when the aqueous composition is used in an amount from 0.1 to 10%, preferably 1 to 5%, more preferably 1 to 3%, by weight based on the dry weight of the substrate to be dyed or printed.

The dyebath or printing paste may further contain conventional additives depending on the blended substrate to be dyed or printed, or the dyeing process used e.g. carboxylic acid of 1 to 5 carbon atoms to adjust the pH, sodium acetate, a tenside.

Dyeing in the presence of the composition according to the invention may be carried out in conventional manner, either in a long bath ratio (from 1:10 to 1:50) or in a short bath ratio (below 1:10). The dyeing process of the invention is effected in one bath according to the one- or two-step method. The dyeing temperature, the pH of the dyebath and, in the case of a two-step process, the addition order of the dyestuffs will depend on the nature of the mixed substrate. Dyeing is preferably carried out according to the exhaust method. Printing with a printing paste containing the composition of the invention may be carried out in known manner.

The compositions of the invention have a good dispersing and anti-precipitation power; therefore, they may be used universally, i.e. with various combinations of cationic dyestuffs together with either disperse or reactive, direct, acid or metal complex dyestuffs. Deep dark tone-in-tone dyeings may be obtained with the process of the invention, particularly deep black tones. The fastness properties of the dyeings obtained are well up to standard; particularly, the dyeings exhibit excellent rubbing fastnesses, more particularly in the case of polyacrylonitrile/wool blends. Bath exhaustion is also good. Furthermore, the compositions of the invention provide little or no foam, particularly at the dyeing temperatures.

The compositions of the invention are particularly suitable for dichromatic or trichromatic dyeing.

In the following Examples, the parts and percentages are by weight unless otherwise stated, and the temperatures are in degrees Centigrade.

EXAMPLE 1

10 parts N-(β-hydroxy-ethyl)-tallow acid amide (commercially available)

15 parts commercially available anionic product obtained from approximately 12 mols of ethylene oxide with a mixture of oleylalcohol and cetylalcohol, followed by carboxymethylation of the final hydroxy group 5 parts commercially available non ionic addition product of approximately 32 mols of ethylene oxide to castor oil (95%), and 10 parts commercially available cationic product obtained from 120 mols ethylene oxide with tallow fatty amino-propylamine (50%)

are mixed by stirring and heating to 90° until homogenization.

60 parts demineralized water heated to 90° are slowly added with stirring to the resulting mixture and the whole is then further stirred for approximately 10–15 minutes until homogenization. The mixture is then cooled to 50° with stirring.

A light yellowish paste is obtained which may be used as such as dyeing or printing auxiliary.

EXAMPLE 2

A wool polyacrylic mixed yarn (55% polyacrylonitrile and 45% wool) is washed for 20 minutes at 40°–60° with a non-ionic surfactant in a liquor to goods ratio of 15:1. After thorough rinsing, the yarn is dyed in a liquor to goods ratio of 15:1 in a bath obtained as follows.

A bath containing, per 1000 parts, 30 parts of the composition of Example 1 and 1 part of sodium acetate is prepared and, after adjustment to pH 5 by addition of acetic acid, 2% of dyestuff C.I. Acid Black 218 are added thereto. The dyebath is heated over a period of 35 minutes from 60° to 95° and the yarn is dyed for 30 minutes at 95°. The dyebath is then cooled to 85° and adjusted to pH 4.2–4.5 with formic acid. 1,5% of a cationic dyestuff mixture commercially available under the name Sandocryl Black B-BLN (Sandoz Switzerland) are added to the same bath. Subsequently the dyebath is heated to 102° over a period of 10 to 15 minutes and the yarn is dyed for 90 to 120 minutes at this temperature. After cooling to 70° over the course of 20 minutes, the yarn is rinsed warm and cold and post-treated for 20 minutes at about 50° with a bath containing, per 1000 parts, 0.5–1 part of a surfactant based on ethoxylated oleic alcohol and 20 parts of acetic acid 40%.

The resulting dyeings have excellent rubbing fastnesses.

EXAMPLE 3

Polyacrylonitrile/polyamide mixed knitted goods 50:50 are pre-treated as disclosed in Example 2 and then dyed with a bath prepared by adding, per 1000 parts, 20 parts of the composition of Example 1 and 1 part sodium acetate, adjusting to pH 5–5.6 with acetic acid and adding 0.35% of the dyestuff C.I. Acid Red 399, 0.2% of the dyestuff C.I. Acid Brown 298 and 0.24% of the dyestuff C.I. Acid Blue 296.

The bath temperature is raised to 60° and then to 95° over a period of 40 minutes (1°/min). The substrate is dyed for 30 minutes at 95° and, after cooling to 80° the dyebath is adjusted to pH 4.5 with formic acid. 0.7% of dyestuff C.I. Basic Red 54 and 0.2% of dyestuff C.I. Basic Blue 41 are added to this bath wich is then heated to the boil over the course of 20 minutes. The knitted substrate is further dyed at the boil for 60 to 90 minutes and, after cooling to 70° over a period of 20 minutes, rinsed warm and then cold. Finally, the dyed substrate is treated for 20 minutes at 50° with a bath containing, per 1000 parts, 0.5–1 part of a surfactant based on ethoxylated oleyl alcohol and 10 parts of acetic acid 40%.

EXAMPLE 4

A polyacrylonitrile/cotton/viscose mixed plush fabric (48:40:12) is pre-washed in a liquor to goods ratio of 30:1 with a non-ionic surfactant (a commercially available higher alkylphenol ethoxylated with 8–12 mols ethylene oxide). After thorough rinsing, the substrate is dyed with a bath prepared by adding, per 1000 parts, 20 parts of the composition of Example 1 and 1 part of sodium acetate, adjusting to pH 4.5 with acetic acid and addition of 0.38% of dyestuff C.I. Basic Yellow 82, 0.1% of dyestuff C.I. Basic Red 104 and 0.062% of dyestuff C.I. Basic Blue 41.

The bath temperature is raised to 40° and then to boiling temperature over the course of 30 minutes. The substrate is dyed for 45–60 minutes at the boil and then the dyebath is cooled to 80°. After pH control (4.5), 1% of dyestuff C.I. Direct Orange 107, 0.33% of dyestuff C.I. Direct Red 220 and 0.065% of dyestuff C.I. Direct Blue 77 are added to this bath. The substrate is dyed for 20 minutes at 80°–85° and, after addition of 1.6 g/l of sodium sulphate, further dyed for 30 min. Subsequently a further 6.4 g/l of sodium sulphate is added to the dyebath which is then cooled to 60° over a period of 20–30 min. After warm and cold rinsing, the resulting substrate is post-treated as disclosed in Example 3.

A beige dyed fabric with good fastnesses is thus obtained.

EXAMPLE 5

A polyacrylonitrile/polyester mixed fabric (50% Dralon and 50% Diolen) is pre-washed according to the procedure of Example 2 for 20 at 60°. After warm and cold rinsing, the fabric is dyed in a liquor to goods ratio of 30:1 with a dyebath prepared as follows.

A bath containing, per 1000 parts, 15 parts of the composition of Example 1 and 1 part sodium acetate is prepared and adjusted to pH 5 with acetic acid. After addition of 2 ml of a non-ionic commercially available surfactant based on polyglycol ether, the following dyestuffs are added to the bath:

0.3% of dyestuff C.I. Disperse Yellow 64
1.5% of dyestuffs C.I. Disperse Blue 87, and
1.5% of dyestuffs C.I. Disperse Blue 183 and 26(1:1)

The bath temperature is raised to 60° and dyeing is carried out for 10 min. After addition of 0.035% of dyestuff C.I. Basic Yellow 64
0.24% of dyestuff C.I. Basic Yellow 13
0.17% of dyestuff C.I. Basic Blue 41 to the dyebath, the temperature of the same is raised to 98° over the course of 30 minutes (0.5°–1°/min) and then to 108° over a period of 15 min. Dyeing is carried out for 90 minutes at 108° and then the dyebath is cooled to 60°–70° over a period of 30 minutes. After thorough warm and cold rinsing, the fabric is post-treated for 20 minutes at 60° in a bath containing, per 1000 parts, 1 part of the surfactant of Example 2 and 1 part of acetic acid.

EXAMPLE 6

A wool polyacrylic mixed yarn 50:50 is dyed in a liquor to goods ratio of 20:1 with a bath containing, per 1000 parts:

0.1% of dyestuff C.I. Basic Yellow 82
0.05% of dyestuff C.I. Basic Red 104
0.33% of dyestuff C.I. Basic Blue 120
0.17% of dyestuff C.I. Acid Red 118
0.18% of dyestuff C.I. Acid Blue 82
1 part of sodium acetate, and
1 part of the composition of Example 1.

The bath is adjusted to pH 4.5 with acetic acid before the addition of the composition. The bath temperature is raised to 50° and then to 98° over the course of 40 min. The substrate is dyed for 45 minutes at this temperature. After cooling to 50°, the substrate is rinsed warm and cold.

A violet dyed yarn is thus obtained.

What we claim is:

1. A composition comprising (A) 10 parts by weight of an anionic product obtained by addition of 5 to 20 mols of ethylene oxide to an aliphatic saturated or unsaturated alcohol of 10 to 24 or a mixture of such alcohols, followed by carboxymethylation of the terminal hydroxy group (B) 1 to 15 parts by weight of a cationic addition product of 50 to 150 mols of ethylene oxide to a fatty amino-($C_{2-3}$)alkylene-amine (C) 1 to 10 parts by weight of a non-ionic addition product of 20 to 150 mols of ethylene oxide to castor oil, or a non-ionic sequenced addition product of 20 to 150 mols of ethylene oxide and 1 to 10 mols of propylene oxide to castor oil, and (D) 1 to 20 parts by weight of a N-(β-hydroxy-($C_{2-4}$)alkyl)-fatty acid amide.

2. A composition according to claim 1, wherein component A is a mixture of oleyl and cetyl alcohol ethoxylated with 10 to 15 ethylene oxide units and further carboxymethylated.

3. A composition according to claim 1, wherein component B is an addition product of 100 to 130 mols of ethylene oxide to tallow fatty amino-propylamine.

4. A composition according to claim 1, wherein component C is an addition product of 20 to 50 mols of ethylene oxide to castor oil.

5. A component according to claim 1, wherein component D is a N-[β-hydroxy-($C_{2-4}$)alkyl]amide of a fatty acid containing from 16 to 22 carbon atoms.

6. A composition according to claim 1 wherein the weight ratio of components A:B:C:D is 10:1–10:1–10:1–15.

7. A composition according to claim 1, in the form of an aqueous composition containing 20 to 50% by weight of the total of components A, B, C and D.

8. A process for dyeing in one bath or printing a mixed textile substrate comprising cationic dyeable fibres and anionic or disperse dyeable fibres, which process comprises using a dyebath or printing paste containing in addition to the dyestuff or dyestuffs a composition according to claim 1.

9. A process according to claim 8 in which the composition comprising components A, B, C and D is employed in the form of an aqueous composition containing 20 to 50% by weight of said components and said aqueous composition is used in an amount from 0.1 to 10% by weight based on the dry weight of the substrate.

10. A process according to claim 9, in which the mixed substrate comprises fibres dyeable with cationic dyestuffs and fibres dyeable with disperse, reactive, acid, direct or metal complex dyestuffs.

11. A composition according to claim 1 wherein component A is an anionic product obtained by addition of 10 to 15 mols of ethylene oxide to an aliphatic saturated or unsaturated alcohol of 12 to 20 carbon atoms, component B is a cationic addition product of 100 to 130 mols of ethylene oxide to a fatty amino-($C_{2-3}$)alkylene-amine and component C is a non-ionic addition product of 20 to 50 mols of ethylene oxide to castor oil or a nonionic sequenced addition product of 10 to 60 mols of ethylene oxide then 1 to 10 mols of propylene oxide and then 10 to 90 mols of ethylene oxide to castor oil.

12. A composition according to claim 2 wherein component B is an addition product of 100 to 130 mols of ethylene oxide to tallow fatty aminopropylamine, component C is an addition product of 20 to 50 mols of ethylene oxide to castor oil, component D is a N-[β-hydroxy-($C_{2-4}$)alkyl]amide of a fatty acid containing 16 to 22 carbon atoms and the weight ratio of components A:B:C:D is 10:1–10:1–10:1–15.

13. A composition according to claim 12 wherein component A is derived from oleyl and cetyl alcohol in weight ratio of 1:2 to 2:1 and component C is an addition product of 25 to 35 mols of ethylene oxide to castor oil.

14. A composition according to claims 1, 11, 12 or 13 wherein the weight ratio of components A:B:C:D is 10:1.5–8:1.5–8:2–8.

15. A composition according to claim 1 comprising (A) 15 parts by weight of an anionic product obtained by addition of about 12 mols of ethylene oxide to a mixture of oleyl alcohol and cetyl alcohol followed by carboxymethylation of the terminal hydroxy group, (B) 5 parts of the cationic addition product of 120 mols of ethylene oxide with tallow fatty amino-propylamine, (C) 4.75 parts of the non-ionic addition product of about 32 mols of ethylene oxide to castor oil, and (D) 10 parts N-(β-hydroxy-ethyl)-tallow fatty acid amide.

16. A process for dyeing in one bath or printing a mixed textile substrate comprising cationic dyeable fibres and anionic or disperse dyeable fibres, which process comprises using a dyebath or printing paste containing in addition to the dyestuff or dyestuffs a composition according to claim 12.

17. A process according to claim 16 in which the composition comprising components A, B, C and D is employed in the form of an aqueous composition containing 25 to 35% by weight of said components and said aqueous composition is used in an amount of from 1 to 5% by weight based on the dry weight of the substrate.

* * * * *